United States Patent [19]

Williams

[11] Patent Number: 4,984,021

[45] Date of Patent: Jan. 8, 1991

[54] PHOTORECEPTOR EDGE ERASE SYSTEM FOR TRI-LEVEL XEROGRAPHY

[75] Inventor: James E. Williams, Rochester, N.Y.

[73] Assignee: Xerox Corporation, Stamford, Conn.

[21] Appl. No.: 456,429

[22] Filed: Dec. 26, 1989

Related U.S. Application Data

[62] Division of Ser. No. 252,097, Sep. 30, 1988, Pat. No. 4,929,024.

[51] Int. Cl.[5] ..... G03G 15/00

[52] U.S. Cl. ..... 355/245; 355/328; 355/218

[58] Field of Search ..... 355/218, 326, 327, 245, 355/246, 265; 430/42, 45

[56] References Cited

U.S. PATENT DOCUMENTS 4,078,929 3/1978 Sundlach ..... 430/42

4,764,443 8/1988 Matkan ..... 430/45

4,847,657 7/1989 Hanada et al. ..... 355/218

*Primary Examiner*—R. L. Moses

[57] ABSTRACT

The prevention of photoreceptor edge development by a discharged image area development system is accomplished by the provison of a photoreceptor charging device which uniformly charges the photoreceptor across its entire width, including the edges thereof outside of the image areas. Thus, when the charged edge areas pass through a discharged-area development housing edge development is precluded. When discharged image area development is used in combination with subsequent charged-image area development as in the case of tri-level, highlight color imaging, photoreceptor edge development is precluded by discharging the edges subsequent to discharged-area development and prior to charged area development.

4 Claims, 2 Drawing Sheets

PHOTORECEPTOR EDGE ERASE SYSTEM FOR TRI-LEVEL XEROGRAPHY

This is a division of application Ser. No. 07/252,097, filed Sept. 30, 1988 now U.S. Pat. No. 4,920,024.

BACKGROUND OF THE INVENTION

This invention relates generally to the rendering of tri-level latent electrostatic images visible and more particularly to the prevention of development of the edges of a charge retentive surface outside of the image area.

In the practice of conventional xerography, it is the general procedure to form electrostatic latent images on a xerographic surface by first uniformly charging a charge retentive surface such as a photoreceptor. Only the imaging area of the photoreceptor is uniformly charged. The image area does not extend across the entire width of the photoreceptor. Accordingly, the edges of the photoreceptor are not charged. The charged area is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner by passing the photoreceptor past a single developer housing. The toner is generally a colored powder which adheres to the charge pattern by electrostatic attraction. The developed image is then fixed to the imaging surface or is transferred to a receiving substrate such as plain paper to which it is fixed by suitable fusing techniques.

In tri-level, highlight color imaging, unlike conventional xerography, the image area contains three voltage levels which correspond to two image areas and to a background voltage area. One of the image areas corresponds to non-discharged (i.e. charged) areas of the photoreceptor while the other image areas correspond to discharged areas of the photoreceptor.

The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically rlatively positive and relatively negative carrier beads. The carrier beads support, respectively, the relatively negative and relatively positive toner particles. Such a developer is generally supplied to the charge pattern by cascading it across the imaging surface supporting the charge pattern. In embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided three, rather than two, ways as is the case in conventional xerography. The photoreceptor is charged, typically to 900 v. It is exposed imagewise, such that one image corresponding to charged image areas (which are subsequently developed by charged-area development, i.e. CAD) stays at the full photoreceptor potential ($V_{cad}$ or $V_{ddp}$, shown in FIG. 1*a*). The other image is exposed to discharge the photoreceptor to its residual potential, i.e. $V_{dad}$ or $V_c$ (typically 100 v) which corresponds to discharged area images that are subsequently developed by discharged-area development (DAD) and the background areas exposed such as to reduce the photoreceptor potential to halfway between the $V_{cad}$ and $V_{dad}$ potentials, (typically 500 v) and is referred to as $V_{white}$ or $V_w$. The CAD developer is typically biased about 100 v ($V_{bb}$, shown in FIG. 1*b*) closer to $V_{cad}$ than $V_{white}$ (about 600 v), and the DAD developer system is biased about 100 v ($V_{cb}$, shown in FIG. 1*b*) closer to $V_{dad}$ than $V_{white}$ (about 400 v).

In a tri-level highlight color imaging system where DAD development precedes CAD, the edges of the photoreceptor are developed with toner thereby causing contamination of the developer materials and other machine components such as belt hole timing sensors. Developer material contaimination results in color developer mixing with the back developer in the black housing and the black developer mixing with the color developer in the color developer housing. This is because these edges are not charged and, therefore, are more positive than the negative toner contained in the DAD developer housing, thus attracting the toner to the non-charged edges. The problem of edge development is also present in conventional xerography when DAD is employed.

BRIEF SUMMARY OF THE INVENTION

Briefly, the present invention obviates the problem of photoreceptor edge development when utilizing discharged area development by the provision of a charging device which charges the photoreceptor edges as well as the imaging area thereof. Thus, when the photoreceptor passes through the DAD housing the toner therein is repelled by the charged edge areas. While this solves the problem of developing the photoreceptor edges as they pass through the DAD housing it would create a similar problem when the photoreceptor passes through the CAD developer housing with the edges thereof in a charged state. Accordingly, a discharge device is provided in the path of movement of the photoreceptor in a location immediately following the DAD housing for discharging the photoreceptor edges. Thus, when the photoreceptor passes through the CAD housing the positive toner therein is not attracted to the photoreceptor edges.

DETAILED DESCRIPTION OF THE PREFERRED EMBODIMENT OF THE INVENTION

Figure 1A:
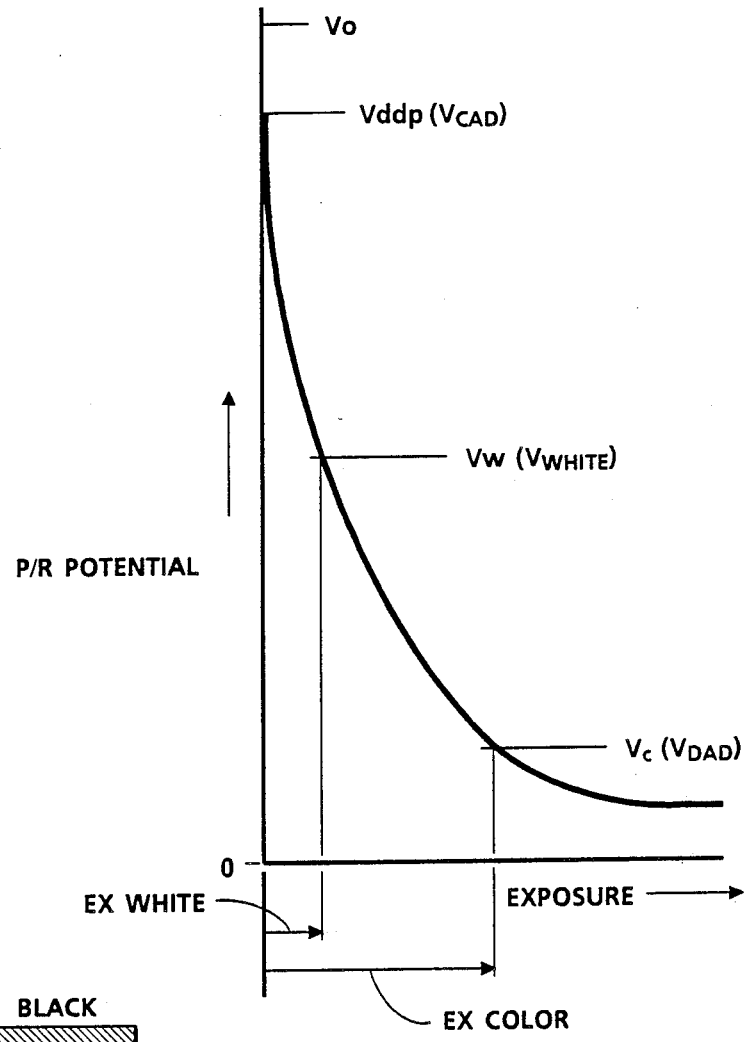
FIG. 1*a* is a plot of photoreceptor potential versus exposure illustrating a tri-level electrostatic latent image.
Figure 1B:
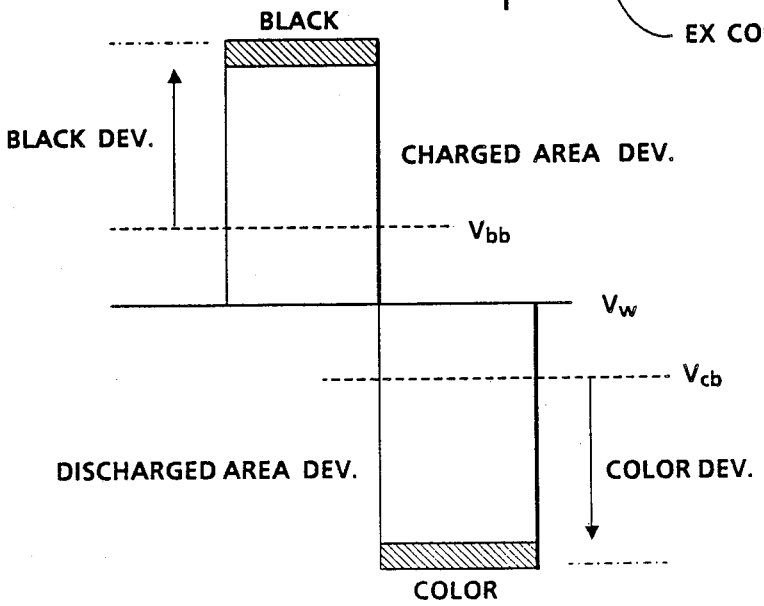
FIG. 1*b* is a plot of photoreceptor potential illustrating single-pass, highlight color latent image characteristics.
Figure 2:
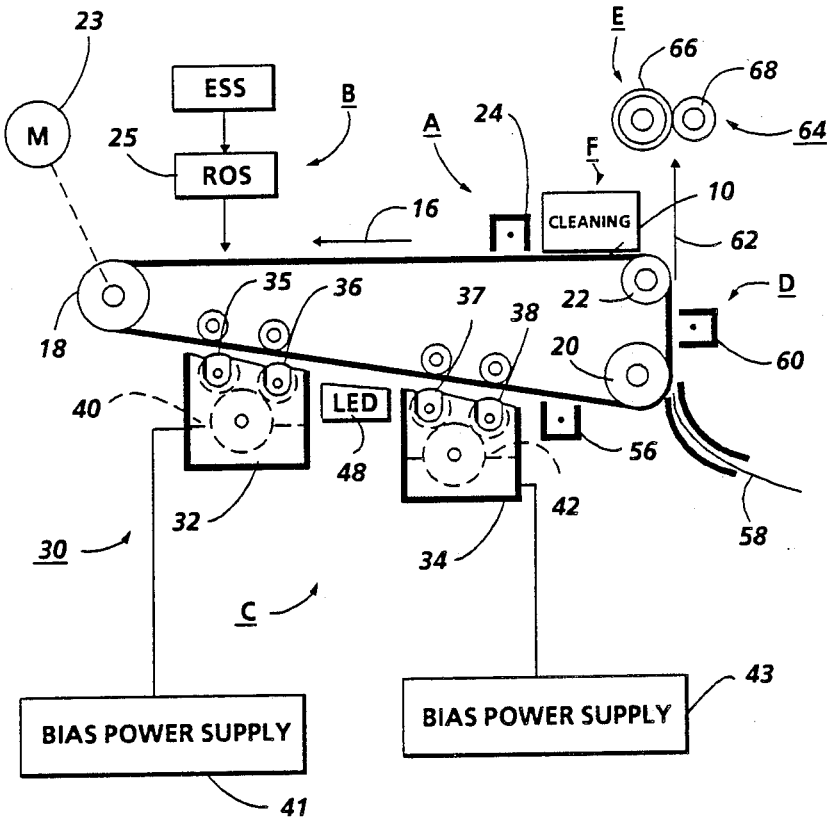
FIG. 2 is schematic illustration of a printing apparatus incorporating the inventive features of the invention.

As shown in FIG. 2, a printing machine incorporating the invention may utilize a charge retentive member in the form of a photoconductive belt 10 consisting of a photoconductive surface and an electrically conductive substrate and mounted for movement past a charging station A, and exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 2, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_O$. Any suitable control, well known in the art, may be employed for controlling the corona discharge device 24.

Next the charged portions of the photoreceptor surface are advanced through exposure station B. At exposure station B, the uniformily charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). The resulting photoreceptor contains both charged-area images and discharged-area images as well as charged edges corresponding to portions of the photoreceptor outside the image areas.

The photoreceptor, which is initially charged to a voltage $V_O$, undergoes dark decay to a level $V_{ddp}$ ($V_{cad}$) equal to about 900 volts. When exposed at the exposure station B it is discharged to $V_c$ ($V_{dad}$) equal to about 100 volts which is near zero or ground potential in the highlight (i.e. color other than black) color parts of the image. See FIG. 2*a*. The photoreceptor is also discharged to $V_w$ ($V_{white}$) equal to 500 volts imagewise in the background (white) image areas. After passing through the exposure station, the photoreceptor contains charged areas and discharged areas which corresponding to two images, the former being at a higher voltage level than the background and the latter being at a lower voltage than the background.

At development station C, a development system, indicated generally by the reference numeral 30 advances developer materials into contact with the electrostatic latent images. The development system 30 comprises first and second developer apparatuses 32 and 34. The developer apparatus 32 comprises a housing containing a pair of magnetic brush rollers 35 and 36. The rollers advance developer material 40 into contact with the photoreceptor for developing the discharged-area images (i.e. those areas of the photoreceptor at voltage level $V_{dad}$). The developer material 40 by way of example contains negatively charged red toner. Electrically biasing is accomplished via power supply 41 electrically connected to developer apparatus 32. A DC bias of approximately 400 volts is applied to the rollers 35 and 36 via the power supply 41.

The developer apparatus 34 comprises a housing containing a pair of magnetic brush rolls 37 and 38. The rollers advance developer material 42 into contact with the photoreceptor for developing the charged-area images. The developer material 42 by way of example contains positively charged black toner for developing the charged-area images (i.e. those areas of the photoreceptor at voltage level $V_{cad}$). Appropriate electrical biasing is accomplished via power supply 43 electrically connected to developer apparatus 34. A suitable DC bias of approximately 600 volts is applied to the rollers 37 and 38 via the bias power supply 43.

A sheet of support material 58 is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Because the composite image developed on the photoreceptor consist of both positive and negative toner, a positive pre-transfer corona discharge member 56 is provided to condition the toner for effective transfer to a substrate using negative corona discharge.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A magnetic brush cleaner housing is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (into shown) floods the photoconductive surface with light to dissipate any residual electrostatic charge remaining prior to the charging thereof for the successive imaging cycle.

In summary, the prevention of photoreceptor edge development by a discharged image area development system is accomplished by the provision of a photoreceptor charging device which uniformly charges the photoreceptor across its entire width, including the edges thereof outside of the image areas. Thus, when the charged edge areas pass through a discharged-area development housing edge development is precluded. When discharged image area development is used in combination with subsequent charged-image area development as in the case of tri-level, highlight color imaging, photoreceptor edge development is precluded by discharging the edges subsequent to discharged-area development prior to charged area development.

What is claimed is:

1. Apparatus for forming discharged area images on a charge retentive surface without developing the edges of the charge retentive surface outside the image areas, said apparatus comprising:

means for uniformly charging a charge retentive surface substantially across its entire width including the edges thereof beyond the image areas thereof;

means for forming a discharged image area on said charge retentive surface intermediate said edges; and means for presenting developer material to said charge retentive surface that is attracted to said discharged image area and repelled by said charged edges.

2. Apparatus according to claim 1 for forming charged image areas on said charge retentive surface;

means for discharging said charged edges of said charge retentive surface subsequent to development of said discharged image area;

means for presenting developer material to said charge retentive surface that is attracted to said charged image areas and repelled by said discharged edges.

3. Apparatus for forming discharged-area toner images on a charge retentive surface without adhering toner to the edges of the charge retentive surface, said apparatus comprising:

means for conditioning the edges of said charge retentive surface so that they repel the toner used for developing discharged-area images; and means for presenting toner to said charge retentive surface that is attracted to said discharged-area images and repelled by said conditioned edges.

4. Apparatus according to claim 3 including means for conditioning the edges of said charge retentive surface so that they repel toner used for charged-area development.

* * * * *